United States Patent [19]

Kümmerlin

[11] 4,403,373

[45] Sep. 13, 1983

[54] HINGE FITTING FOR FOLDABLE LADDERS

[76] Inventor: Walter Kümmerlin, In den Fressackern 6, D-7120 Bietigheim-Bissingen, Fed. Rep. of Germany

[21] Appl. No.: 231,555

[22] Filed: Feb. 4, 1981

[30] Foreign Application Priority Data

Feb. 15, 1980 [DE] Fed. Rep. of Germany ..... 3005692
Feb. 15, 1980 [DE] Fed. Rep. of Germany ..... 3005693

[51] Int. Cl.[3] ..... E05D 11/10

[52] U.S. Cl. ..... 16/327; 16/326; 16/328

[58] Field of Search ..... 16/321, 322, 323, 324, 16/326, 327, 328, 330, 331, 334, 349, 362, 363, 364

[56] References Cited

U.S. PATENT DOCUMENTS 2,024,039 12/1935 Harting ..... 16/326 X
3,955,240 5/1976 Schuh et al. ..... 16/326

FOREIGN PATENT DOCUMENTS 1023617 3/1966 United Kingdom ..... 16/326
1079354 8/1967 United Kingdom ..... 16/328

*Primary Examiner*—Paul A. Bell
*Attorney, Agent, or Firm*—Martin A. Farber

[57] ABSTRACT

A hinge fitting for a foldable ladder having two fitting parts connected to each other by a hollow hinge pin, an interlocking device with openings in the two fitting parts to the openings in one fitting part respectively there is associated one of each of positions of swing permitting interlocking, a guide pin mounted turnably and longitudinally displaceably in the hinge pin, at least one locking bolt spaced radially from the hinge pin and arranged parallel to it, the locking bolt being movable by means of a handle connecting it to the guide pin against the force of a return spring from an interlocking position (with the locking bolt engaging into aligned of the openings of the two fitting parts) into an unlocked position with the locking bolt being located outside the opening of the one fitting part, and a locking device which secures the guide pin towards the end of its displacement from the interlocking positions into the unlocked position and without impairing its turnability against return into the interlocking position under the action of the return spring, the locking device having at least one spring locking element coordinated to the guide pin and the hinge pin in connection with one of the two pins which carries the locking element along upon movement of said one pin, the locking element in said unlocked position engaging in a locking position thereof into a recess in the other pin, and at least one control element for bringing the locking element into its unlocked position out of engagement with the recess by a swinging movement of the fitting parts by a predetermined angle which angle aligns a surface region of the one fitting part with the locking bolt, which surface region prevents the return of the locking bolt into the interlocked position. The recess has a length which is limited in the circumferential direction of the one pin and is limited at least at one end by a guide surface of the control element, the guide surface guides the locking element out of the recess.

22 Claims, 12 Drawing Figures

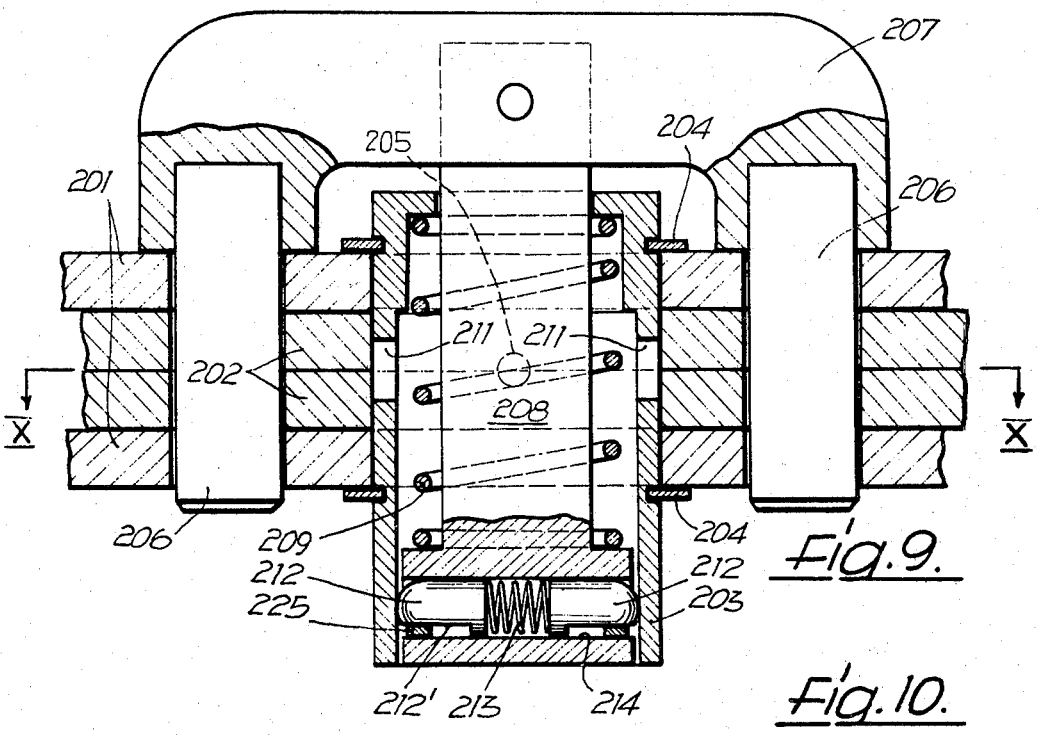
Fig. 9.
Fig. 10.
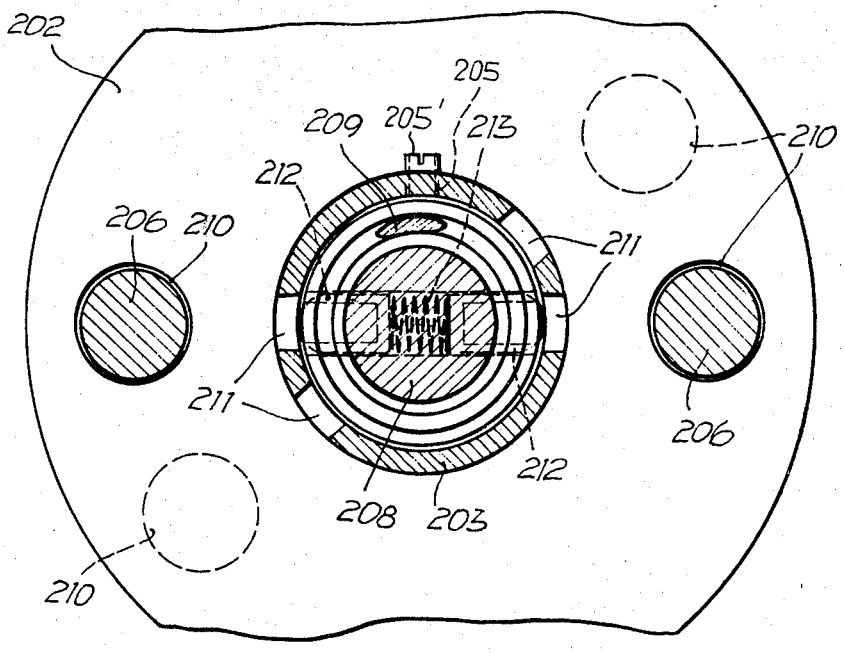

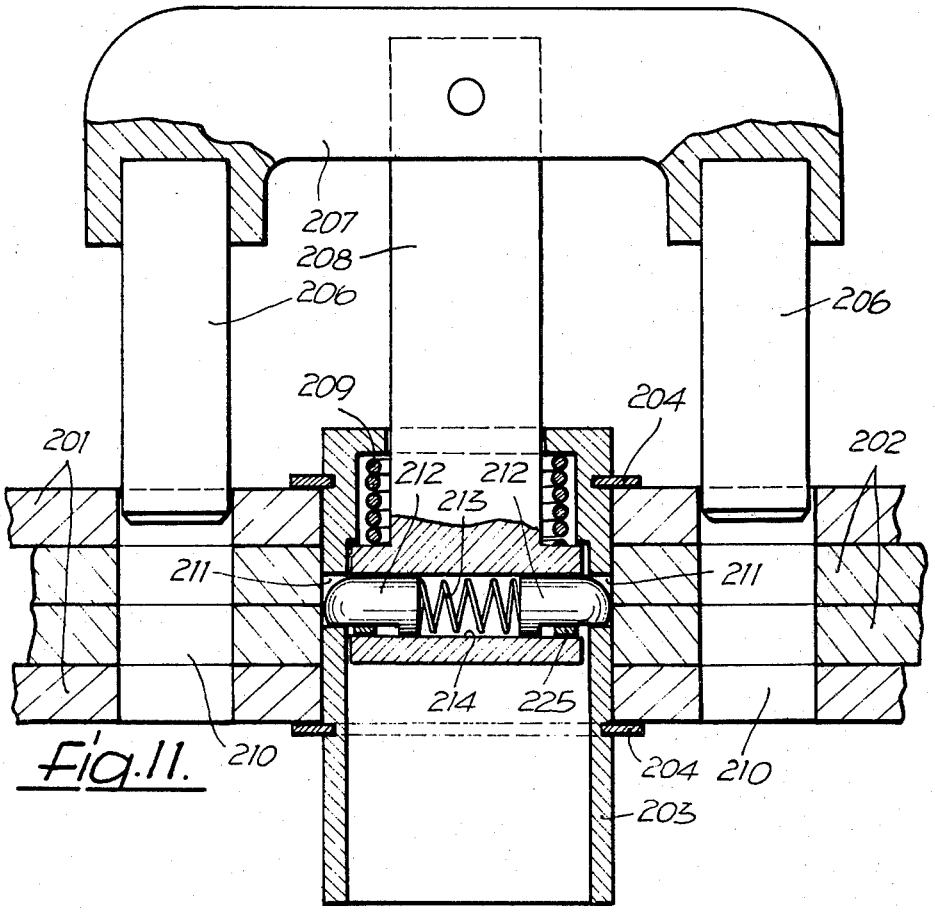
Fig.11.
Fig.12.
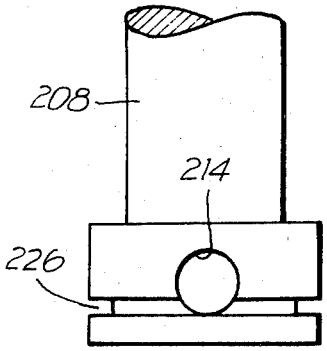
Fig.13.
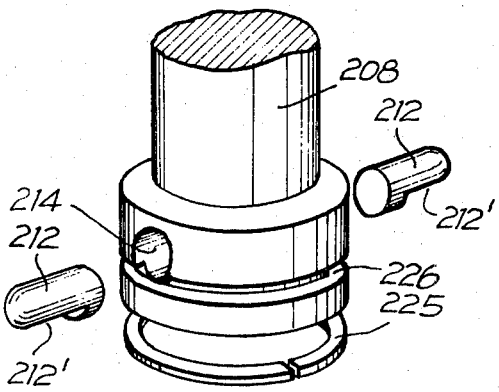

HINGE FITTING FOR FOLDABLE LADDERS

BACKGROUND OF THE INVENTION

1. Field of the Invention

The present invention relates to a hinge fitting for foldable ladders.

2. Description of the Prior Art

In one known hinge fitting (West German Utility Model No. 78 11 073), as a result of the locking device, the two lock bolts need not, for automatic locking in a different swing position be brought before the start of the swinging movement, into the boreholes associated with the new position of swing, but need only be brought into the unlocked position. This known hinge fitting is, however, expensive and, in particular is trouble-prone. For example, the guidance of the guide pin, developed as a relatively thin pin, within the hinge pin is poor since the diameter of the central opening in the end of the hinge pin through which the guide pin is brought out is adapted to the larger diameter of a conical section which is required in order to spread apart a hairpin-shaped spring forming the spring locking element to such an extent that it can engage in an annular groove in the guide pin. The poor guidance of the guide pin can lead to the canting of the locking bolts. The problem is, however, also due to the fact that the hollow hinge pin is made of plastic because of its complicated shape. This complicated shape is in part due to the mounting of the hairpin-shaped spring in two diametric slots in the hinge pin directly adjacent the end thereof, but in particular also to the projections provided within the hinge pin, extending in its longitudinal direction, which are required together with projections on a disk provided on the end of the guide pin opposite the handle in order to bring the hairpin-shaped spring back out of engagement with the annular groove of the guide pin before, upon a swinging motion of the parts of the fitting relative to each other, the next position is reached in which the fitting parts can be locked. As soon as the unavoidable wear of the plastic projections has reached a certain degree the locking device will no longer open. The fact that the hinge pin consists of plastic is, however, also disadvantageous insofar as, due to this, the hinge pin is not guaranteed against breakage and its operability can be impaired by influences of temperature. Another disadvantage is that due to the force-held engagement of the hairpin-shaped spring into the annular groove, the force of the return spring must be correlated to the holding force of the locking device which, together with the plate required at one end of the guide pin, leads to a relatively large axial length of the hinge pin. Finally it should also be mentioned that external disturbing influences, for instance grease which has penetrated into the mounting pin, can cause the locking device no longer to operate dependably.

SUMMARY OF THE INVENTION

The object of the present invention is to create a hinge fitting for foldable ladders which, although for automatic locking in a new position of swing, the locking bolt or bolts also need only be brought into the unlocked position, is however not prone to disturbance and is practically free of wear yet, nevertheless of a simple construction. This object is achieved by means of a hinge fitting having the features that the recess (11; 111; 211) has a length which is limited in the circumferential direction of the pin (3, 8; 103, 108; 203, 208) and is limited at least at one end by a guide surface of the control element (16; 116) which guides the locking element (12; 112; 212) out of the recess (11; 111; 211). The development of the locking device in accordance with the invention leads to simple shapes of all parts, including the hinge pin, so that even the latter can be produced at low cost from metal. Since, furthermore, each of the control elements present need form only one guide surface on which the locking element slides during a swinging movement of the fixture parts relative to each other in the circumferential direction of the hinge pin and is thereby removed from the recess, the locking element also has a shape which can be readily produced in metal. The wear of all parts, including that of the control elements, can therefore be kept so low as to be insignificant during the life of the hinge pin. Another advantage is that the guide pin may have close guidance in the hinge pin and have an outer diameter which is only slightly smaller than the inside diameter of the hinge pin, whereby an excellent guiding of the guide pin and of the locking bolts is obtained. However, the hinge pin, due to the fact that it can be made of metal, can also fulfill its function much more reliably than a hinge pin of plastic can. Another advantage is the smaller structural length since the length is determined only by the length required for the hinge pin.

The engagement of the locking element into the recess preferably takes place in form-locked manner with respect to a movement of the guide pin into the position corresponding to the locked position of the locking bolt. In this way not only is the locking device prevented from being opened again by an unintentional push against the handle but in particular the force of the return spring can be selected without reference to the holding force of the locking device, which is important with respect to the space which is required for the return spring, and furthermore the locking device is completely impervious to external influences, such as, for instance, grease which has penetrated.

In a preferred embodiment, each recess is formed by a slot provided in the pin wall in the circumferential direction of the pin. Since it is unimportant, in principle, within which of the two pins the recess or recesses are provided, such slots can be provided either in the hinge pin or in the guide pin. The first-mentioned possibility is, however, as a rule more advantageous due to the possibility of arranging the locking device or elements in space-saving manner within the guide pin.

Since each control element merely has the purpose of ejecting a locking element from the associated recess upon a swinging movement of the parts of the fitting relative to each other, it is preferably formed by the portion of the pin which limits said recess in circumferential direction, at least on one end. It can therefore be formed by a part of the boundary surface of the ejector and thus does not represent a separate component, which further simplifies the construction of the hinge fitting of the invention.

The specific development of the locking elements can be effected in various manners since the only thing essential is that each locking element be so connected with said one pin that the pin carries it along upon its movement and the locking element be movable under spring action over a path which has at least one component in the radial direction of the pin. However, a particularly simple construction is obtained by the provision of at least two locking elements, which are arranged preferably uniformly distributed over the circumference of the two pins and are formed by radial tongue-forming sections of a flexure spring. In such case not only is the expense for the locking elements themselves very small, since only a single flexure spring is required, but the connection to said one pin can be effected in a manner which is particularly simple structurally and, furthermore, symmetrically arranged locking elements assist in the maintaining of a coaxial position of the two pins. In a preferred embodiment, the flexure spring, which preferably consists of wire, lies within the hollow guide pin. The end sections which form the locking elements pass in this case from the wall of the guide pin. Insofar as the flexure spring is not already sufficiently secured as a result of this passage against the displacement of its central section in axial direction, an additional safety can also be provided for this. For instance, the central section could engage into a groove in the inner wall of the guide pin. From a manufacturing standpoint, however, it is simpler to form a tongue-shaped projection also on the central section and to have it engage into a recess, for instance a borehole, in the wall of the guide pin.

The locking elements can, however, also be formed, for instance, of spring-loaded balls or spring-leaded longitudinally displaceable pins. Such pins are particularly advantageous if their radially outwardly pointing end is developed in semispherical shape since then, in the same way as in the case of balls, boreholes in the other pins are sufficient for the engagement of the locking elements inasmuch as, due to the curved surface of the part of the locking element engaging into the borehole, the wall of the borehole together with the edge formed at the transition of the cylindrical surface of the pin can serve as a guide surface. If the pins are flattened on that side which is pressed against the wall of the borehole by the action of the return spring for the guide pin, one then obtains a form-locked (positive locking by the form of the parts thereof) engagement of the guide pin in the return direction, which permits the use of a strong return spring and prevents unintended loosening of the lock.

In order to be able to lock a hinge fitting, and in particular a hinge fitting in accordance with the invention, optionally in the two angular positions of the fitting parts which correspond to the transport position and the double-ladder position or permit the swingability of the two fitting parts between these two positions and limit the range of swing only in the two end positions by means of the locking bolt and therefore create an option not present in the known hinge fittings, it is possible, in one advantageous embodiment, for the guide pin, together with the locking bolt or bolts to be moved not only out of the locking position into the unlocked position, from which an automatic locking is effected as soon as the two parts of the fitting assume a different lockable angular position, for instance the angular position corresponding to the double-ladder position, but also to be moved in the opposite direction into a release position in which the two parts of the fitting are swingable freely within a fixed range of swing which is limited by the locking bolt or bolts.

In one preferred embodiment, the parts of the fitting are provided for this purpose not only with one borehole each per locking bolt for both the transport portion of the ladder and the double-ladder position, but these two boreholes of the part of the fitting lying on the handle side are connected with each other by an arcuate slot which follows the path of the locking bolt and the width of which is smaller than the diameter of the boreholes. Furthermore, each locking bolt present is provided in the section lying between the part of the fitting and the handle in its locked position, and over a length which is at least equal to the thickness of the fitting part and the handle in its locked position, which permits movement within the slot. This constriction need then only be brought by suitable displacement of the guide pin and of the locking bolt into a position in which it lies within the slot.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIG. 9 is a section corresponding to FIG. 2 through the third embodiment;

FIG. 10 is a section along the line X—X of FIG. 9;

FIG. 11 is a section corresponding to FIG. 3 through the third embodiment;

FIG. 12 is a partially shown view of the free end section of the guide pin of the third embodiment; and FIG. 13 is a partial perspective exploded view of the free end section of the guide pin of the third embodiment with the parts borne by it.

DESCRIPTION OF THE PREFERRED EMBODIMENTS

Figure 1:
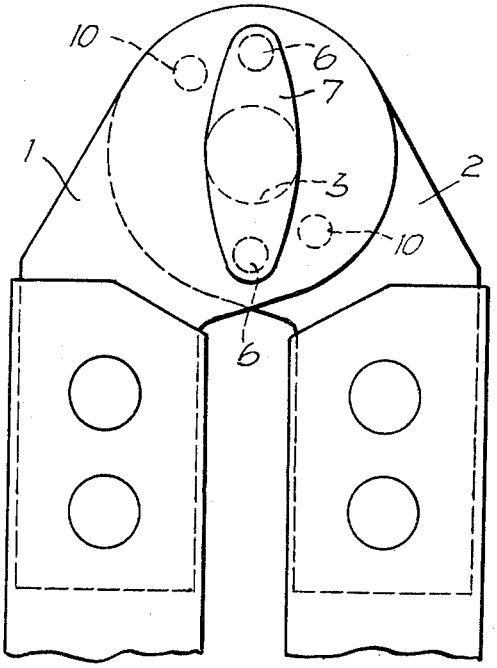
FIG. 1 is a front view of the first embodiment.

A hinge fitting for a foldable ladder which can be used both as a double ladder and as a leaning ladder has two fitting parts, designated generally as 1 and 2 respectively, each of which has a circular flange region. A hollow hinge pin 3 which connects the two fitting parts 1 and 2 in articulated manner to each other passes through the center of the coinciding flange regions. A retaining ring 4, which is inserted in an outer annular groove at one end of the hinge pin 3, and an annular shoulder provided spaced from it on the hinge pin 3 or a second retaining ring hold the flange regions on the hinge pin together, each of which flange regions, as shown in FIGS. 2 and 3, consists of two plates, the two plates of one fitting part lying between those of the other. A projection which protrudes radially from the outer cylindrical surface of the hinge pin 3 and which, in the embodiment shown, is formed by a grub screw inserted into a threaded borehole 5 engages into a longitudinal groove of the inner plates of the fitting part 2 and thereby connects the hinge pin 3 fast for rotation to said fitting part. The fitting part 1, on the other hand, is mounted for turning on the hinge pin 3. In order to be able to lock the fitting in form-locked manner in the angular position of the two fitting parts 1 and 2 shown in FIG. 1 which corresponds to the transport position of a ladder and in the angular positions present when the ladder is used as double ladder and as leaning ladder, a locking device is provided which has two locking bolts 6 of identical development arranged diametrically to the hinge pin 3 and parallel to its longitudinal axis, said bolts being connected at their one end firmly to each other by a yoke-shaped handle 7. Within the hinge pin 3 there is mounted for rotation and longitudinal displacement a hollow guide pin 8 which like the hinge pin 3 consists of steel and which extends out of the hinge pin 3 at one end and is firmly connected at said end, in the center between the two locking bolts 6, with the handle 7. As shown in FIGS. 2 and 3, the end section of the guide pin 8 which is within the hinge pin 3 has an increased diameter which is adapted to the diameter of the hinge pin 3 in order to obtain good guidance. Otherwise the outside diameter of the guide pin 8 is selected in such a manner that an annular space which is just sufficient to receive a return spring 9 developed as a coil spring is disposed between the guide pin 8 and the inner cylindrical surface of the hinge pin 3. Since the required wall thickness of the guide pin 8 is relatively slight, the outside diameter of the guide pin 8 is therefore not substantially smaller than the inside diameter of the hinge pin. The return spring 9 rests at one end against the shoulder of the guide pin 8 which is present at the transition to the end section of larger outside diameter and at the other end against an inner shoulder on the end of the hinge pin 3 facing the handle 7 since said hinge pin has here a reduced inside diameter which is adapted to the outside diameter of the guide pin 8 so as to provide good guidance for the guide pin 8 also at the place of its emergence from the hinge pin 3. In order to receive the locking bolts 6 the flange regions are provided with boreholes 10 which are so arranged as to form continuous channels for both locking bolts 6 in the three angular positions in which the two fitting parts 1 and 2 are capable of being interlocked so as to be able to lock a ladder in the transport position, in which its two legs lie parallel to each other, in the position as double ladder and in the position as leaning ladder, as is shown in FIGS. 2 and 3 for an angular position.

In order to release the two fitting parts 1 and 2 for swinging into a different angular position, one grasps the handle 7 and pulls it away from the hinge fitting against the force of the return spring 9. The movement of translation which the two locking bolts 6 and the guide pin 8 carry out in this connection is limited, as shown in FIG. 3, by means of the return spring 9 in a position of the locking bolts 6 in which they still engage into one of the two outside plates. Now the two fitting parts 1 and 2 can be swung freely within their range of swing.

In order not to have to hold the handle 7 against the action of the return spring 9 in the position shown in FIG. 3 which corresponds to the unlocked position of the locking bolts until, as a result of the subsequent swinging, the boreholes in the flange region of the second fitting part are no longer aligned with those of the first fitting part (since in such a case two persons would be necessary to effect a swinging movement of the ladder, one of whom would have to hold the handle of the two hinge fittings, which are customarily present on both ladder side pieces in the unlocked position until the other person had somewhat changed the angular position of the two ladder legs), a locking position is provided which automatically holds the two locking bolts 6 and the guide pin 8 in the unlocked position until the boreholes in the flange regions are no longer aligned with each other. This locking device includes slots 11 in the wall of the hinge pin 3. In the embodiment shown, these slots 11 are produced by milling or sawing. As shown in FIGS. 2 and 3 the slots 11 lie in that section of the hinge pin 3 which extends towards the handle 7 out of the two fitting parts 1 and 2 and in the unlocked position surrounds an annular zone of the end section of large diameter of the guide pin 8. Furthermore, these figures show that the slots 11 are limited in axial direction by surfaces which lie in radial planes perpendicular to the longitudinal axis of the hinge pin 3. As shown in FIG. 4, the slots 11 are of limited length in circumferential direction and are arranged in pairs diametrically opposite each other. The angle between the two pairs is equal to the angle by which the fitting parts 1 and 2 must be swung relative to each other in order to be able to change from the angular position corresponding to the transport position into the angular position corresponding to the double-ladder position, or vice versa. The slots 11 are, namely, so arranged on the circumference of the hinge pin 3 that two locking elements 12 can engage into them in each of the three positions in which the two fitting parts 1 and 2 can be locked. These two identically developed locking elements are formed by the two end sections of a flexure spring 13 each of which is bent into a radially outward protruding tongue or elongated eye, the spring being produced from a round wire and lying within the guide pin 8. In order that the two end sections can engage into the slots 11 the guide pin 8 is provided at diametrically opposite points with one opening 14 each in that zone which is directed towards the slots 11 in the unlocked position of the guide pin and of the locking bolts, which opening may in each case consist of a borehole. The locking elements 12 are displaceably guided in radial direction in these two openings 14, an initial tension in the central section of the flexure spring 13 causing the two locking elements 12 to endeavor to assume a position in which they protrude to the maximum extent beyond the outer cylindrical surface of the guide pin 8. In order to secure the middle section of the flexure spring 13 against displacement in axial direction, it is provided with a tongue 13' which is bent therefrom and protrudes radially outwardly and engages into a borehole 15 in the guide pin. Of course the middle section could also be secured in some other manner, for instance by means of a groove extending in circumferential direction, is securing, in view of the guiding of the locking elements 12 in the openings 14 is necessary at all.

If by a corresponding pull on the handle 7 of the guide pin 8 the two locking bolts 6 are brought into the unlocked position shown in FIG. 3, the two locking elements 12 move outwardly under spring action and engage into the slots 11 which are directed towards them. Since this engagement, in view of the fact that the abutment surfaces of the slots lie in radial planes, is form-locked for displacement in axial direction of the guide pin, the return spring 9, regardless of its spring force, can no longer move the guide pin 8 and the locking bolts 6 back into the locking position when the handle 7 is released after the engagement of the locking elements into the slots. Upon the dimensioning of the return spring therefore the holding force of the locking device need not be taken into consideration.

As shown in FIG. 4, the locking elements 12 are of a width which decreases towards their outer end. Furthermore, those surfaces which limit the slots 11 in circumferential direction form a cam element 16 each in the form of a ramp. Therefore if the two fitting parts 1 and 2 are swung after they have been unlocked, each of the obliquely extending side surfaces of the locking elements 17 is brought against one of these ramps along which they then slide out of the slots upon the further swinging and then come again to rest against the inner cylindrical surface of the hinge pin 3. The length of the slots 11, measured in circumferential direction, is therefore so selected that the locking elements 12 are only pressed radially inwardly out of the slots 11, upon a swinging movement of the fitting parts 1 and 2, after the boreholes 10 are no longer aligned with each other, but, however, in sufficient time before the reaching of the next position of swing in which a locking of the fitting parts is possible. After the locking elements 12 have been pressed out of the slots 11, the return spring 9 namely presses the locking bolts 6 against the inner flange region of the second fitting part 2 so that automatic locking takes place as soon as the bores 10 of said part are aligned with the bores 10 in the flange region of the first fitting part.

If, in the case of this hinge fitting, instead of a locking in the angular position corresponding to the double-ladder position, swingability between said angular position and the angular position corresponding to the transport position is desired, then two slots would have to be provided in one flange region. To be sure, it would then be necessary, for instance, to arrange both the slots and the boreholes as well as the locking bolts at different distances from the hinge pin. An embodiment which does not have to have different distances of the locking bolts and of the boreholes and slots associated with them in the flange parts and furthermore affords the possibility of alternately locking the two fitting parts in the angular position corresponding to the double-ladder position or of being able to swing them between this angular position and the angular position corresponding to the transport position is shown in FIGS. 5 to 8.

The two fitting parts 101 and 102 of this embodiment have their circular flange regions overlapping. The hollow hinge pin 103, which is developed in the same manner as in the first embodiment, passes through the center of these two flange regions and connects the two fitting parts in articulated manner with each other. Retaining rings 104 which are arranged in annular grooves in the outer wall of the hinge pin 103 secure the flange regions on the hinge pin. By means of a grub screw (not shown) which is secured from the outside into a radial threaded borehole 105 in the hinge pin 103, 105 and engages into a groove in the fitting part 102, the threaded pin 103 is connected, fast for rotation, with this fitting part while the other fitting part 101 is supported for free rotation on the hinge pin.

Figure 5:
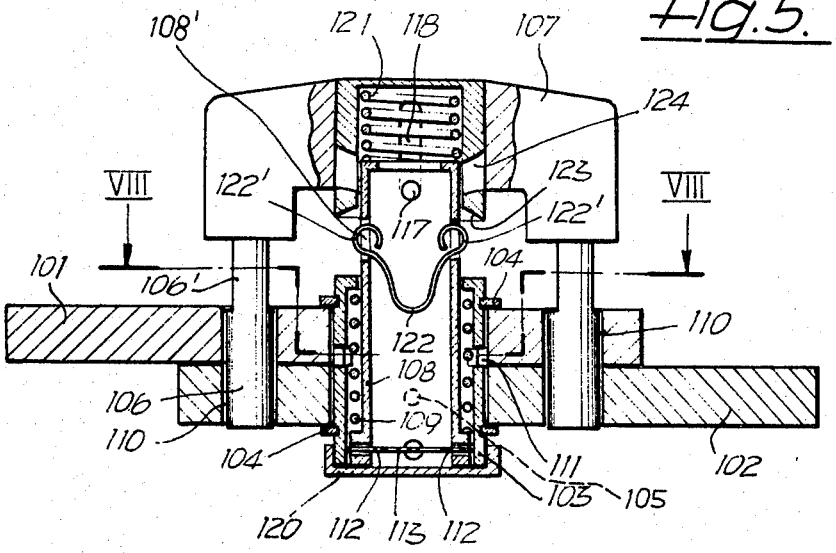
FIG. 5 is a section corresponding to FIG. 2 through the second embodiment.

Two locking bolts 106 which are arranged diametrically with respect to the hinge pin 103 and at the same distance from it and the longitudinal axis of which lies parallel to the longitudinal axis of the hinge pin 103 form, as in the case of the first embodiment, parts of a locking device by means of which the two fitting parts can be locked in given angular positions. The one end of these two locking bolts 106 is firmly connected with a yoke-shaped handle 107. A guide pin 108, also hollow, is mounted for rotation and axial displacement in the hollow hinge pin 103, the one end of said guide pin engaging in longitudinally displaceable but non-rotatable manner into the central part of the handle 107, which part is developed in the form of a bushing, as shown in FIG. 5. For this connection, the guide pin is provided with a pin 117 which engages into a longitudinal groove 118 of the handle 107. Within the annular space between the inner cylindrical surface of the hinge pin 103 and the outer cylindrical surface of the guide pin 108 there is arranged a return spring 109, developed as a coil spring which, as in the embodiment of FIGS. 1 to 3, rests at the one end against the shoulder on the guide pin 108 and at the other end against the shoulder on the hinge pin 103. These two shoulders are formed by an end section of large diameter on the guide pin 108 and an end section of smaller diameter on the hinge pin 103. Good guidance of the guide pin within the hinge pin is assured by these two end sections.

As in the case of the first embodiment, the flange region of the first fitting part 101 is provided with two diametrically opposite boreholes 110 into which the two locking bolts 106 engage. In the same way as in the first embodiment, the second fitting part 102 is provided with two pairs each of diametrically arranged boreholes 110 which are so arranged that the one pair of boreholes is aligned, in the angular position of the fitting parts which corresponds to the transport position of a ladder and in the angular position corresponding to the position as a leaning ladder, with the two boreholes 110 of the first fitting part, while the other pair of boreholes is aligned with these two boreholes of the fitting part 101 when the two fitting parts have an angular position which corresponds to the double-ladder position. The hinge fitting can therefore be locked in these three angular positions.

Figure 2:
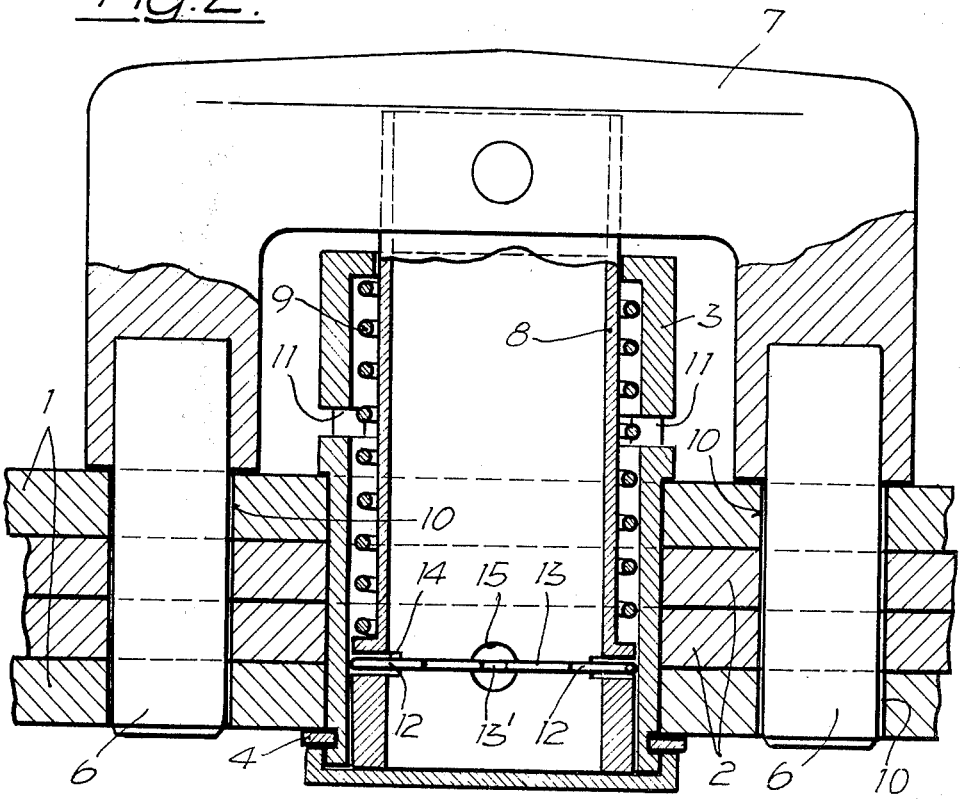
FIG. 2 is a section through the first embodiment in locked condition.
Figure 3:
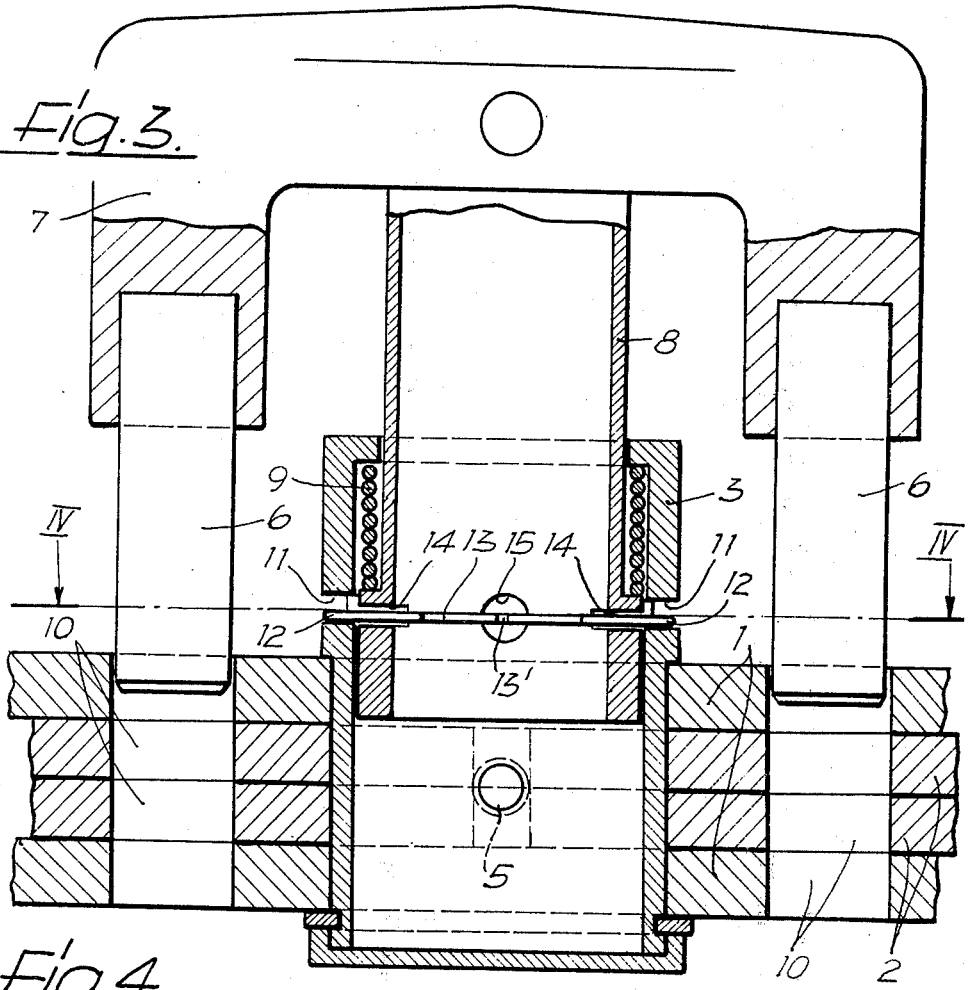
FIG. 3 is a section through the first embodiment in unlocked condition.
Figure 4:
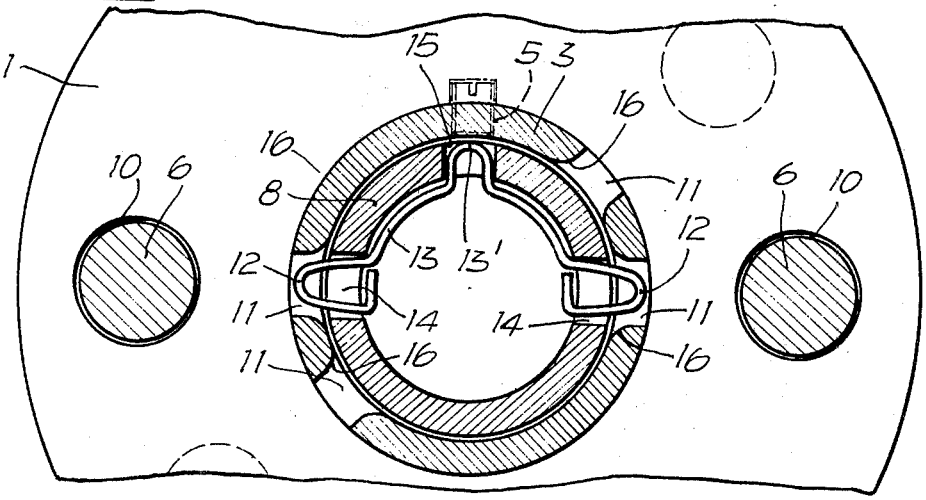
FIG. 4 is a section along the line IV—IV of FIG. 3.

A locking device developed in the same manner as in the embodiment of FIGS. 1 to 3 makes it possible for the handle 107 to be released after, as a result of its actuation, the locking bolts 106 have been brought into the unlocked position and nevertheless for automatic locking in the new position of swing to take place. The hinge pin 103 for this purpose is provided in the same manner as the hinge pin 3 with slots 111 extending in circumferential direction and limited in said direction, for the engagement of two locking elements 112 which are formed by the end sections of a flexure spring 113. Each of these end sections is guided in radially displaceable manner in an opening in the guide pin 108 within which the central section of the flexure spring 113 lies and is secured against axial displacement. The two locking elements 112 automatically come into engagement in two of the slots 111 when the locking bolts 106 and the guide pin 108 have been moved in axial direction to such an extent, against the force of the return spring, that the locking bolts are no longer in engagement with the boreholes 110 of the second fitting part 102 and are therefore in their unlocked position. The pressing of the locking elements 112 out of the slots 111 takes place by a swinging of the fitting parts due to the fact that the locking elements come against the guide surfaces which limit the slot in longitudinal direction and each of which forms a cam element 116 on which they are transferred, as on a ramp, onto the inner cylindrical surface of the hinge pin. The slots 111, which produce a form-interlocking engagement of the locking element 112 with respect to a load in the axial direction, are arranged in the same manner as in the first embodiment and so dimensioned with respect to their length in the circumferential direction that in each lockable position there is present a pair of slots into which the locking elements 112 can engage when the locking bolts 106 are brought into the unlocking position and that the locking elements are pressed out of said slots, upon a swinging motion, before reaching the next position of swing in which a locking of the fitting parts is possible.

Figure 8:
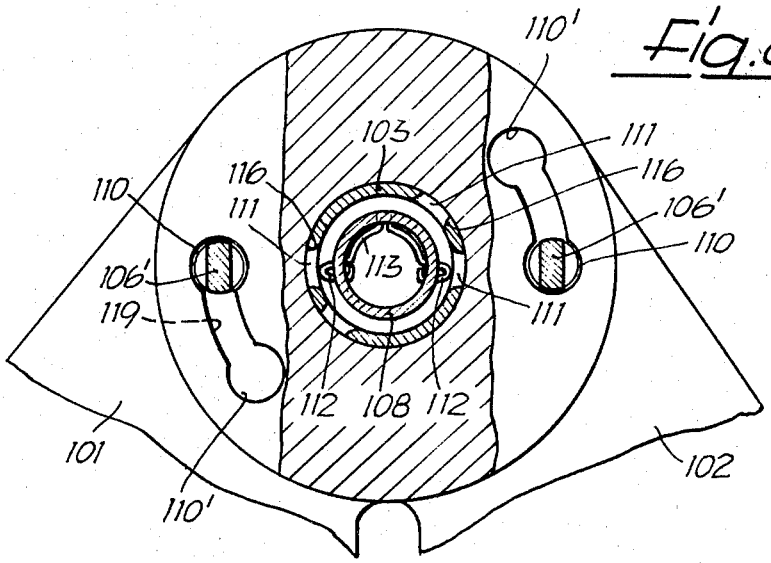
FIG. 8 is a section along the line VIII—VIII of FIG. 5.

In order not only to be able to lock the hinge fitting in the three positions mentioned but also to be able to swing it freely, if desired, between the angular position corresponding to the transport position and the angular position corresponding to the double-ladder position, the flange region of the first fitting part 101 located on the side of the handle is provided with two additional diametrically opposite boreholes 110' and two slots 119 which extend on a circular path concentric to the hinge pin 103 from one borehole 110 to the other borehole 110', as shown in FIG. 8. The angle between the boreholes 110 and the boreholes 110' corresponds to the range of swing within which free swingability of the fitting parts is to be possible.

As shown in FIG. 5, that section of the two locking bolts 106 which in the locking position lies between the handle 107 and the side of the adjacent fitting part 101 facing it and the length of which is slightly greater than the thickness of the flange region of the fitting part 101 is milled both on the radially outer side and on the radially inner side. As a result of this constriction, this section of the locking bolts 106 forms a web 106' the thickness of which in radial direction is somewhat less than the width of the slot 119. When the webs 106' are in engagement with the flange region of the first fitting part 101 the two fitting parts can therefore be swung relative to each other since the webs can be moved from the borehole 110 to the borehole 110' through the slot 119 which receives them.

Figure 6:
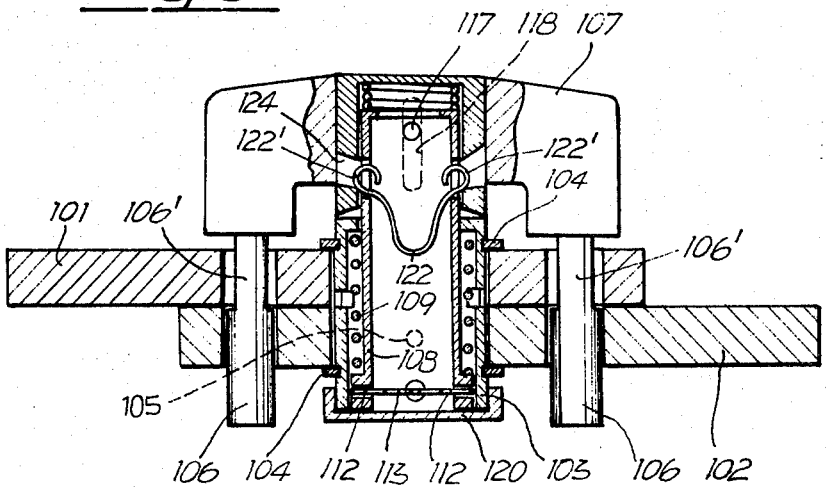
FIG. 6 is a section through the second embodiment in the position permitting swinging between the position of swing corresponding to the transport position and the position of swing corresponding to the double ladder position.
Figure 7:
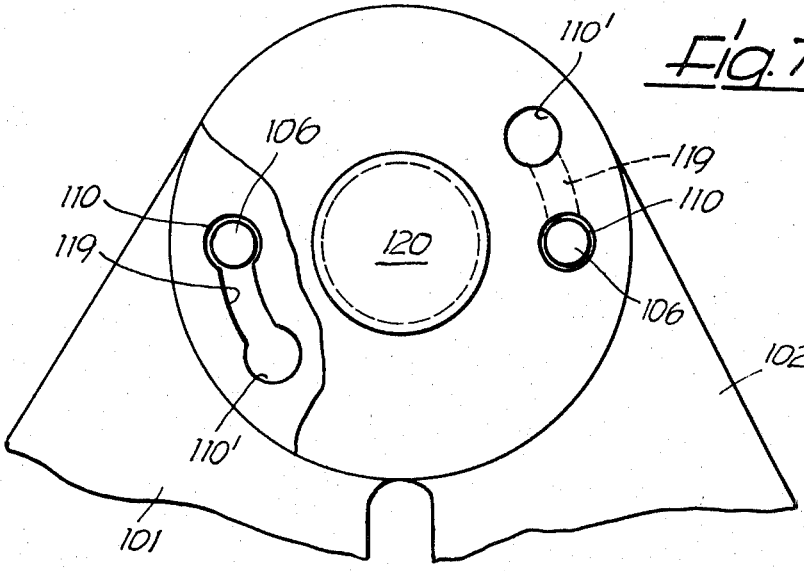
FIG. 7 is a view of the second embodiment seen from the side facing away from the handle.

In order to bring the locking bolts 106 into their released position in which the fitting parts are freely swingable within the angular range defined by the boreholes 110 and 110', the handle 107 must be pushed towards the first fitting part 101. A cover 120 which covers the hinge pin 103 on the side facing away from the handle and prevents the guide pin 108 from emerging at this end of the hinge pin does not interfere with this displacement of the handle 107 since the latter is displaceable on the guide pin 108 in the longitudinal direction of the pin by the required amount which is determined by the slot 117. When, after the displacement of the handle 106 opposite to the direction of movement necessary for bridging the locking bolts 106 into the unlocked position, the position of release is reached, a detent device enters into action and holds the handle in the released position against the force of the return spring 109, which is inserted into the borehole of the handle receiving the guide pin 108 and rests against the end surface of the guide pin. The detent device comprises a flexure spring 122 of a development similar to that of the flexure spring 113 and which lies within the guide pin 108 and whose eye-shaped end section 122' passes from the inside to the outside through diametrically located boreholes 108' in the wall of the guide pin. When the handle has been pushed against the first fitting part 101, guide surfaces 123 on the handle 107 first of all urge the end sections 122' radially inwardly against the force of the flexure spring until they rest against the inner cylindrical surface of the borehole in the handle which receives the guide pin. The bushing-like part of the handle which forms this borehole is provided, as shown by way of illustration in FIG. 5, with two diametrically arranged openings 124 into which the two end sections 122' engage when the release position is reached (FIG. 6). The limiting surfaces of the openings 124 are developed in such a manner that the end sections 122' can, by a pull exerted on the handle, again be brought out of engagement from the openings 124 so as to be able to bring the handle 107, assisted by the return spring 121, back into the locking position shown in FIG. 5.

The boreholes 110' make it possible to bring the locking bolts 106 from the release position into the locking position not only in the angular position corresponding to the transport position but also in the angular position corresponding to the double-ladder position. If it is sufficient to effect this transfer only in the angular position corresponding to the transport position, the boreholes 110 are not required. It is then merely necessary to make the slots 119 correspondingly longer.

The third embodiment of the hinge fitting of the invention, shown in FIGS. 9 to 13, is substantially identical to the first embodiment shown in FIGS. 1 to 4. Therefore, only the differences will be described below and corresponding parts will be designated by reference numbers which are larger by 200.

The guide pin 208 which is guided in turnable and longitudinally displaceable manner in the hinge pin 203, is connected at its end which emerges from the hinge pin rigidly to the yoke-shaped handle 207 which bears the two identically developed locking bolts 206 which are arranged diametrically to the hinge pin and parallel to its longitudinal axis. The other end section of the guide pin 208 which, as in the first embodiment, has an enlarged outside diameter which is adapted to the inside diameter of the hinge pin 203 is provided with a continuous transverse bore 214 in which two locking pins 212 are longitudinally displaceable. Between the facing ends of the two locking pins 212 there is arranged a pretensioned coil compression spring 213 which attempts to push the locking pins 212 out of the transverse bore 214. The locking pins 212 therefore form spring locking elements. Because of the transverse bore 214, the guide pin 208 is not hollow but solid. However, it would of course also be possible for that section which adjoins the end section having the transverse bore 214 to be hollow.

The outside end of each of the two identically developed locking pins 212 is of semispherical development. Furthermore, as shown in FIGS. 9, 11 and 13, the locking pins 212 are provided with a flattening 212' which lies parallel to the longitudinal axis of the locking pin and terminates at at distance from the end resting against the spring so that this end section has a circular cross section. Against the flattening 212' there rests a spring ring 225 which is formed of spring material of rectangular cross section and lies in an annular groove 226 provided in the end section of the guide pin 208. This annular groove is so arranged with respect to the transverse bore 214 that it still just intersects the transverse bore 214. The reduction in diameter of the blocking pins 212 which is caused by the flattening 212' is adapted to the thickness of the spring ring 225 which therefore forms, on the one hand, a guide surface for the flattening 212' in the region of the exit opening of the transverse bore 214 so that the locking pins 212 can be displaced in their longitudinal direction without jamming. On the other hand, the spring ring 225 prevents rotation of the locking pins 212 around their longitudinal axis so that the flattening 212' always points towards the free end of the guide pin. Finally, the spring ring 225 furthermore also prevents the locking pins 212 from being forced completely out of the transverse bore 214 by the coil compression spring 213 since the ring 225 forms a stop for the end of the circular cross section of the blocking pins 212.

In the region in which the hollow hinge pin 203 passes through the two flange regions of the fitting parts 201 and 202, the wall of the hinge pin is provided with two pairs of diametrically arranged boreholes 211 whose longitudinal axes lie in a common radial plane of the hinge pin. In the embodiment shown by way of example, this radial plane lies in the central plane of the circular flange region of the fitting part 202 which is formed of two plates resting on each other and is rigidly connected, fixed for rotation, to the hinge pin. The hinge pin is provided for this purpose with a radial threaded borehole 205 into which a grub screw 205' is threaded which engages on the other side in a blind borehole in the flange region of the fitting part 202, as shown in particular by FIG. 10. The similarly circular flange region of the other fitting part 201 which, as in the case of the first embodiment, consists of two plates which receive the flange region of the fitting part 202 between each other is, on the other hand, mounted on the hinge pin 203 in turnable manner but secured against axial displacement by spring rings 204.

The diameter of the boreholes 211 is adapted to the diameter of the locking pins 212. The latter is greater in the embodiment shown by way of example than the wall thickness of the hinge pin in the region of the boreholes 211. In this way the result is obtained that the depth of penetration of the locking pins 212 into the boreholes 211 is less when they are aligned with them than the radius of the semispherical end section. This provides assurance that the locking pins 212 can be forced out of the boreholes 210 by turning the guide pin 208 relative to the hinge pin 203 against the force of the coil compression spring 213 without the boreholes having to have beveled guide surfaces. However, it would also be possible to limit the depth of penetration of the locking pins 212 to the desired value by means of the spring washer 225. As shown in FIG. 10, the boreholes 211 are so arranged that the two locking pins 212 can engage into them when the two fitting parts 201, 202 are in one of the three positions of swing in which they can be locked by means of the two locking bolts 206 due to the fact that they penetrate into the boreholes 210 provided in the flange regions.

As shown in FIG. 9, the hinge pin 203 protrudes so far beyond the side of the flange region of the fitting part 201 facing away from the handle 207 that the end section of the guide pin 208 which supports the locking pins 212 terminates flush with the hinge pin 203 when the two locking bolts 206 completely pass through the flange regions. If the two fitting parts are now to be swung relative to each other then the locking bolts 206 will be pulled back by means of the handle 207 to such an extent that they still only engage into the flange region of the fitting part 201 which is adjacent the handle. Upon this movement of translation the guide pin 208 is pushed, increasing the tension of the return spring 209 which acts on it and lies in the annular space between it and the hinge pin 203, so far within the hinge pin that the locking pins 212 are aligned with two of the boreholes 211 and penetrate a distance into them. Since upon the release of the handle the return spring forces the flat 212' of the flattening 212' of the locking pins 212 against the wall of the boreholes 211, the locking pins and the boreholes form a detent device which is form-locked against the return direction of movement of the hinge pin.

If now the two fitting parts are swung relative to each other, then the locking pins 212, due to their semispherical end sections, are again pressed out of the boreholes 211. The angle of swing which is necessary in order to force the locking pins 212 completely out of the boreholes 211 is, however, so great that the locking bolts 206 can no longer penetrate into the boreholes 210 when the locking pins 212 have become inactive. It is only when, during the course of the swinging movement of the two fitting parts, a position is reached in which the fitting parts can be locked that the return spring 209 effects an automatic displacement of the guide pin 208 and thus also of the locking bolts 206 into the locking position since the locking pins 212 are now no longer active. Since the locking pins 212 were forced out of the boreholes 211 at the start of the swinging movement, the return spring 209 namely effects a displacement of the guide pin 208 towards the locking position to such an extent that the locking bolts 206 rest against the flange region of the fitting part 202. This displacement is sufficient to prevent the locking pins 212 from entering into the boreholes 211 at the end of the swinging motion.

With regard to the details not mentioned, reference is had to the statements made with reference to the embodiment shown in FIGS. 1 to 4. Of course, this third embodiment could also be so developed, corresponding to the embodiment of FIGS. 5 to 8, that the two fitting parts can be optionally locked in two successive swinging positions or moved between these two positions without having to loosen the interlock.

I claim:

1. In a hinge fitting for foldable ladders, having two fitting parts connected with each other in flange regions of said fitting parts by a hollow hinge pin and having a locking device which comprises at least one locking bolt, mounted for swinging parallel to the hinge axis and movable by means of a handle from an interlocking position into an unlocked position and openings formed in the flange regions of the fitting parts, said at least one locking bolt being insertable into the openings in predetermined angular positions of the fitting parts relative to each other, at least one of said openings is connected with a slot in one of said flange regions which extends from said one opening over a path which is concentric to the hinge axis, the improvement wherein the width of said slot measured in radial direction is less than the width measured in radial direction of the opening which is connected with the slot, the locking bolt has a constriction in a section thereof, in the interlocking position said constriction is at least partially longitudinally outside the openings of the two flange regions and is alignable by a longitudinal displacement of the locking bolt with said one flange region with the slot, said constriction having a shape which permits a relative movement within the slot in longitudinal direction of the slot.

2. The hinge fitting according to claim 1, wherein the locking bolt is guided in longitudinally displaceable manner in both directions from said interlocking position and the constriction is located in said section of said locking bolt which upon a longitudinal displacement of the locking bolt from said interlocking position in a direction opposite the direction of movement into said unlocked position, comes into alignment with said one flange region with the slot.

3. The hinge fitting according to claim 2, wherein the one flange region having said slot therein lies closer to the handle than the other of said flange regions, and the constriction is in the section which in the interlocking position of the locking bolt is located between the flange regions and the handle.

4. The hinge fitting according to claim 1, wherein each end of the slot is in communication with a respective one of the openings.

5. The hinge fitting according to claim 1, wherein the openings are boreholes and the constriction of the locking bolt is formed respectively by a flattening on radially inner and radially outer sides of said locking bolt with respect to said hinge axis, a remainder of the locking bolt is cylindrical.

6. The hinge fitting according to claim 1, a guide pin is operatively connected to the at least one locking bolt via the handle, said guide pin is rotatably and longitudinally displaceably mounted within the hinge pin, locking means for holding said guide pin fixed in said unlocked position of said locking bolt locking the guide pin in form-locked manner against movement out of its locked position and for being disconnectable only by a turning movement of the fitting parts relative to each other.

7. The hinge fitting according to claim 6, wherein the handle is jointly rotatably connected to the guide pin with limited relative longitudinal displacement and detent means for longitudinally locking said handle on said guide pin in a position in which the constriction is aligned with said one flange region having the slot.

8. In a hinge fitting for a foldable ladder having two fitting parts swingably connected to each other by a hollow hinge pin, an interlocking device comprising, openings in the two fitting parts, respective of the openings in one fitting part being associated with corresponding positions of swing permitting interlocking of the interlocking device with the openings of the fitting parts, a guide pin mounted turnably and longitudinally displaceably in the hinge pin, at least one locking bolt spaced radially from and parallel to the hinge pin, the locking bolt by means of a handle connecting the locking bolt to the guide pin being movable against the force of a return spring from an interlocking position, with the locking bolt engaging into aligned of the openings of the two fitting parts, into an unlocked position with the locking bolt being located outside the opening of the one fitting part, and a locking device which secures the guide pin at the end of its displacement from the interlocking position into the unlocked position against return into the interlocking position under the action of the return spring without preventing turning of the guide pin, the locking device having at least one spring locking element coordinated to the guide pin and the hinge pin in connection with one of the two pins which carries the locking element along therewith upon movement of said one pin, in said unlocked position said locking element engaging in a locking position of said locking element into a recess in the other pin, and at least one control element for bringing the locking element into an unlocked position of said locking element out of engagement with the recess through a swinging movement of the fitting parts by a predetermined angle which angle aligns a surface region of the one fitting part with the locking bolt, which surface region prevents the return of the locking bolt into the interlocking position, the improvement wherein said at least one control element defines a guide surface, said recess has a length which is limited in the circumferential direction of at least one of said pins and is limited at least at one end by said guide surface of the control element, said guide surface guides the locking element out of the recess.

9. The hinge fitting according to claim 8, wherein said one of said two pins is said guide pin and said other pin is said hinge pin, said locking element engages into the recess form-locked with respect to a movement of the guide pin into a position corresponding to the interlocking position of the locking bolt.

10. The hinge fitting according to claim 9, wherein at least a surface which bounds the recess in the direction of the longitudinal axis of said pins on one side lies in a plane which is intersected perpendicularly by said longitudinal axis.

11. The hinge fitting according to claim 8, wherein each said recess is formed by a slot in a wall of said other pin, said slot extends in the circumferential direction of said other pin.

12. The hinge fitting according to claim 8, wherein each of the positions of swing of the fitting parts which permits the interlocking has associated with it one said recess for each said locking element.

13. The hinge fitting according to claim 8, wherein each said control element is formed by a portion of said other pin which limits the associated said recess in circumferential direction at least at one end.

14. The hinge fitting according to claim 8, including a flexure spring having radial sections, and at least two of the locking elements are arranged circumferentially with respect to the two said pins and are formed by said radial sections of said flexure spring which form radial tongues.

15. The hinge fitting according to claim 14, wherein said guide pin is formed as a hollow guide pin and defines openings therein, the flexure spring lies within the hollow guide pin, said one of said two pins is said guide pin and said other pin is said hinge pin, end sections of said flexure spring form the locking elements and pass from the inside to the outside of said hollow guide pin through said openings in the guide pin and a central section of the flexure spring is secured against displacement in longitudinal direction of the guide pin.

16. The hinge fitting according to claim 8, wherein each said locking element is formed as a spring-biased pin which is displaceable in a direction having at least a radial component.

17. A hinge fitting according to claim 16, wherein each said spring-biased pin has a semi-spherical outer end as well as a flattening, said one of said two pins is said guide pin and is formed with an annular groove, means for securing the spring-biased pin against turning around its longitudinal axis comprising a spring ring inserted in said annular groove in the guide pin, the latter carries said spring-biased pin and said spring ring forms a resting surface for the flattening.

18. The hinge fitting according to claim 8, wherein an end section of the guide pin extends out of the hinge pin to the handle, both said end section and another end section of the guide pin are guided in the hinge pin.

19. The hinge fitting according to claim 8, wherein said return spring constituting a coil spring is disposed between said guide pin and said hinge pin, the outside diameter of the guide pin in a section surrounded by the return spring is smaller only by an amount necessary for the coil spring than the inside diameter of the hinge pin in a section thereof, which receives the coil spring.

20. The hinge fitting according to claim 8, and wherein in addition to the openings in the two fitting parts for the interlocking in different angular positions, comprising means for receiving the at least one locking bolt in a flange region of the other fitting part on a side of the handle respectively comprising a slot which extends from the opening in said other fitting part associated with the transport position of the ladder towards a position corresponding to a double-ladder position and follows along a circular arc through the center of said opening, the width of said slot being smaller than the diameter of the opening, each said at least one locking bolt has a section located in said interlocking position between the handle and the fitting parts and a length of said section which is at least equal to the thickness of said other fitting part with the slot is formed with a constriction shaped so as to permit a movement in the slot and the handle together with the at least one locking bolt is displaceable, from said interlocking position opposite a direction of movement for transfer into said unlocked position of said locking bolt, into a released position in which the constriction is located in the associated said slot.

21. The hinge fitting according to claim 20, further comprising spring means for operatively biasing the locking bolt from the released position into the interlocking position, detent means for holding the locking bolt in the released position against the force of said spring means.

22. The hinge fitting according to claim 20 or 21, wherein each said slot in the flange region of said other fitting part connects the opening associated with the transport position with said opening associated with the double-ladder position.

* * * * *